US005909168A

United States Patent [19]

Miyasaka et al.

[11] Patent Number: 5,909,168

[45] Date of Patent: Jun. 1, 1999

[54] PTC CONDUCTIVE POLYMER DEVICES

[75] Inventors: Naofumi Miyasaka; Takashi Hasanuma, both of Chiba; Syozo Fukuyama, Ibaragi, all of Japan

[73] Assignee: Raychem Corporation, Menlo Park, Calif.

[21] Appl. No.: 08/599,566

[22] Filed: Feb. 9, 1996

[51] Int. Cl.[6] ..... H01C 7/10

[52] U.S. Cl. ..... 338/22 R; 338/225 S; 338/276; 338/322; 338/316; 338/277; 338/234

[58] Field of Search ..... 338/22 R, 22 SD, 338/322, 324, 276, 277, 316, 234, 236

[56] References Cited

U.S. PATENT DOCUMENTS

| | | | |
|---|---|---|---|
| 2,664,487 | 12/1953 | Gorden | 338/233 |
| 4,099,154 | 7/1978 | Bar | 338/220 |
| 4,214,353 | 7/1980 | Kalina | 29/25.42 |
| 4,357,590 | 11/1982 | Belhomme | 338/23 |
| 4,635,026 | 1/1987 | Takeuchi | 338/22 SD |
| 4,864,624 | 9/1989 | Tichy | 381/55 |
| 4,924,204 | 5/1990 | Uchida | 338/22 R |
| 4,939,498 | 7/1990 | Yamada et al. | 338/22 R |
| 5,142,265 | 8/1992 | Motoyoshi et al. | 338/22 R |
| 5,153,555 | 10/1992 | Enomoto et al. | 338/22 R |
| 5,233,326 | 8/1993 | Motoyoshi | 338/22 R |
| 5,451,921 | 9/1995 | Crawford et al. | 338/220 |

FOREIGN PATENT DOCUMENTS

| | | | |
|---|---|---|---|
| 63-285901 | 11/1988 | Japan | 338/22 R |
| 3-165007 | 7/1991 | Japan | 338/22 R |
| 5-82303 | 4/1993 | Japan . | |
| 5-82305 | 4/1993 | Japan . | |

OTHER PUBLICATIONS

Japanese Utility Model No. 2–41663, published Mar. 22, 1990.

Japanese Utility Model No. 2–41664, published Mar. 22, 1990.

*Primary Examiner*—Michael L. Gellner
*Assistant Examiner*—Karl Easthom
*Attorney, Agent, or Firm*—Timothy H. P. Richardson; Marguerite E. Gerstner; Herbert G. Burkard

[57] ABSTRACT

A housing contains a PTC element which can be easily inserted and removed. Conductive metal retaining elements of the housing are secured to the base of the housing, and retain the PTC element with a generally planar portion parallel to the electrodes of the PTC component. The retaining elements also have slidable contact between the elements and the top of the housing so as to modify the elastic deformation of the element and allow for insertion and removal of the PTC element.

5 Claims, 2 Drawing Sheets

PTC CONDUCTIVE POLYMER DEVICES

BACKGROUND OF THE INVENTION

1. Field of the Invention

This invention relates to PTC conductive polymer devices.

2. Introduction to the Invention

Many electrical devices comprise two laminar electrodes and, sandwiched between them, a laminar resistive element which exhibits PTC (positive temperature coefficient) behavior, in particular circuit protection devices. The PTC resistive element may be composed of conductive polymer (this term being used to denote a composition comprising a polymer and, dispersed or otherwise distributed therein, a particulate conductive filler) or a ceramic, e.g. a doped barium titanate. When a conductive polymer is used, such devices are generally prepared by stamping (or otherwise cutting) a plurality of the devices out of a laminate of a sheet of the conductive polymer between two metal foils. When a ceramic is used, such devices are usually prepared by applying liquid electrode material to the major surfaces of a preformed laminar resistive element, and solidifying the liquid electrode material.

Devices of this kind are sometimes installed between two separate resilient retaining members which bear on opposite faces of the device. Typically, there are two metal retaining members which are directly opposite to each other and which bear on the outer faces of the electrodes. More specialized installations are described for example in U.S. Pat. Nos. 4,924,204 (Uchida) and 5,451,921 (Crawford et al.) the disclosures of which are incorporated herein by reference. Care is needed to ensure that an appropriate pressure is generated and maintained between the retaining members and the PTC device.

One disadvantage of some of the known installations is that the retaining members are secured to a larger structure, e.g. a motor housing, in a way that is difficult to accomplish and/or permits the retaining members to move relative to each other, thus changing the pressure that they exert on the PTC device. In other installations, the retaining members extend from the PTC element in the form of terminals (which may be male or female) and these terminals are connected to complementary connectors which are fixed to a circuit board or other rigid substrate.

SUMMARY OF THE INVENTION

We have now discovered improved PTC devices which can be remarkably simple, and which are, therefore, cheap and easy to make, but which nonetheless offer other important advantages. The devices of the invention are particularly suitable for providing a connection, accompanied by overcurrent protection, between two wires whose ends are free (either because a length of wire has been cut to enable the PTC device to be inserted, or because two wires from different sources are to be joined together). We have found the devices to be particularly useful for protecting loudspeakers from excessive currents.

In a first preferred aspect, this invention provides a PTC device which comprises (1) a housing which is composed of an electrically insulating material;

(2) a first metal member which
- (a) is secured to the housing, and
- (b) comprises
  - (i) a first terminal element which lies outside the housing, and
  - (ii) a first retaining element which is elastically deformed and at least a part of which lies within and is spaced apart from the housing;

(3) a second metal member which
- (a) is secured to the housing, and
- (b) comprises
  - (i) a second terminal element which lies outside the housing, and
  - (ii) a second retaining element which is elastically deformed and at least a part of which lies within and is spaced apart from the housing; and (4) a PTC component which
- (a) comprises
  - (i) a first laminar metal electrode,
  - (ii) a second laminar metal electrode which is parallel to the first electrode, and
  - (iii) a laminar resistive element which is composed of a PTC conductive polymer and which is sandwiched between the first and second electrodes,
- (b) is positioned between the first and second retaining elements, with the first electrode being in physical and electrical contact with the first retaining element and the second electrode being in physical and electrical contact with the second retaining element, and
- (c) is removably maintained in position between the first and second retaining elements by elastic recovery forces exerted on the first and second electrodes by the first and second retaining elements.

In a second preferred aspect, this invention provides an electrical assembly which comprises first and second wires each having a female connector secured thereto, and a PTC device according to the first aspect of the invention in which the terminal elements are male terminal elements respectively secured to the female connectors.

BRIEF DESCRIPTION OF THE DRAWING

The invention is illustrated in the accompanying drawing in which.

DETAILED DESCRIPTION OF THE INVENTION

Figure 1:
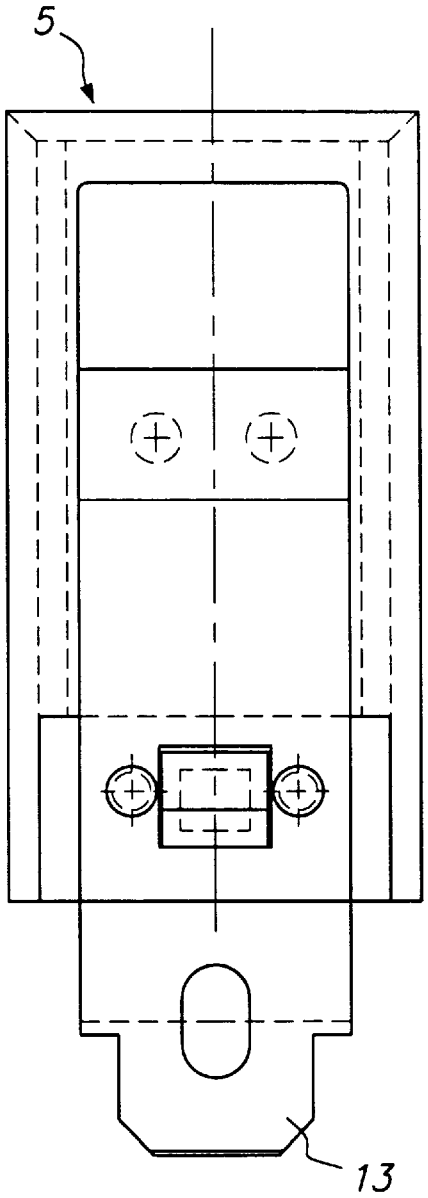
FIGS. 1–2 illustrate a first embodiment of the invention.

The housing 5 can be of any appropriate shape but is preferably an open box, so that the PTC element can be easily inserted and removed. Preferably the housing comprises (i) a base 1 having first and second spaced-apart apertures therethrough, and (i) side walls 2 extending away from the base; and the first metal member passes through the first aperture and the second metal member passes through the second aperture. Preferably the base is rectangular, and the side walls are at right angles to the base. The side walls provide physical protection to the retaining members and the PTC element 3. Preferably, therefore, the walls are higher than both the PTC element and the retaining elements.

The apertures 4 in the base of the housing can pass through the body thereof, but preferably each is in the form of a slot having one edge defined by a side wall. The metal member and the side wall and/or the base can have cooperating members which help to provide a secure fitting between the metal members and the housing.

Figure 3:
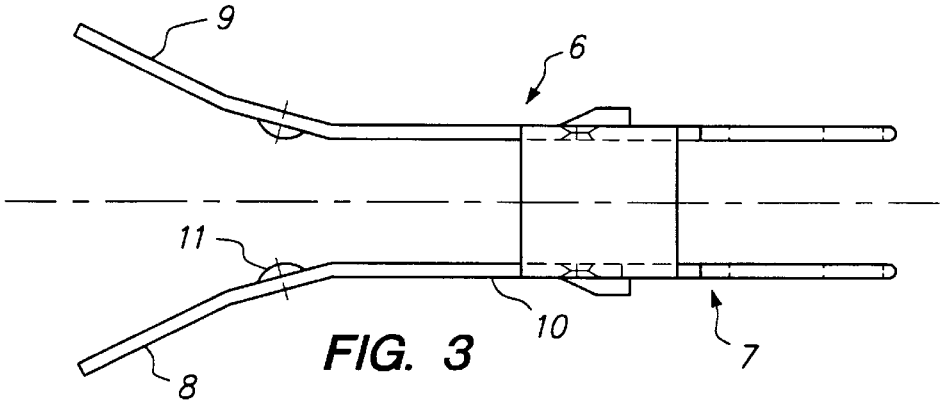
FIGS. 3–4 illustrate a metal member suitable for use in the invention.
Figure 4:
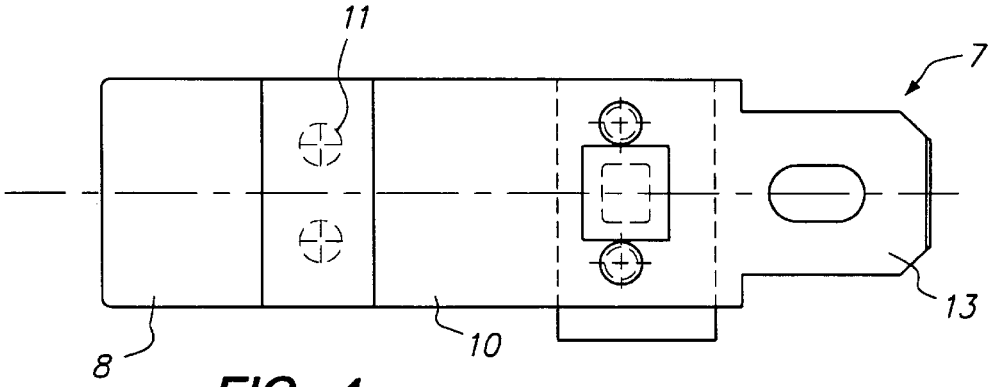
Figure 5:
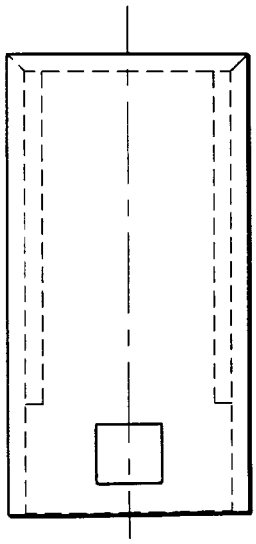
FIGS. 5–8 illustrate a housing suitable for use in the invention.
Figure 6:
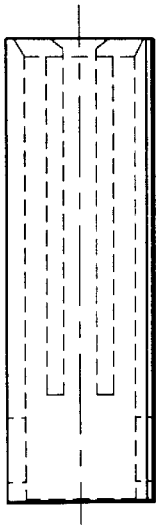
Figure 7:
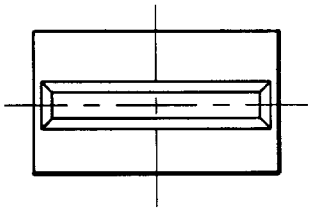
Figure 8:
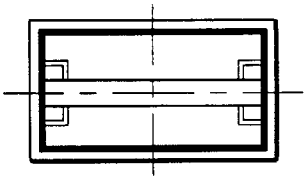

The first and second metal members (as best shown in FIGS. 3 and 4) are preferably each a single piece of appropriately shaped metal. Each metal member must be secured to the housing, preferably by a secure bond between the member and the base in the region of the aperature 4 in the base 1 through which the member passes. Preferably the members are not otherwise secured to the housing. However, there may be slidable contact between the members and the housing so as to modify the elastic deformation of the member, and in consequence the forces exerted on the PTC component.

Figure 2:
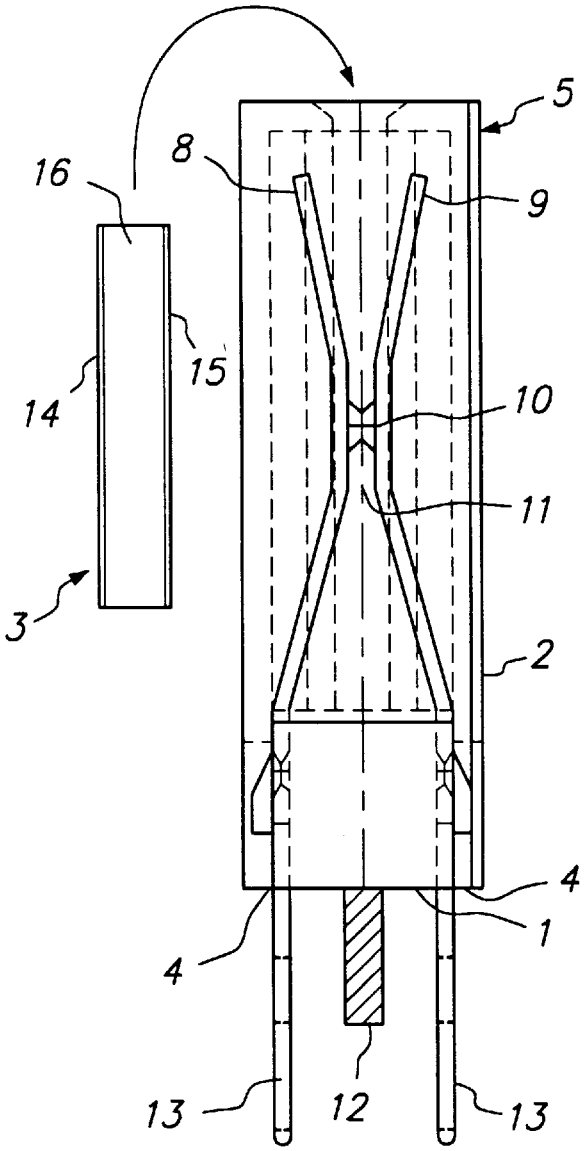

FIG. 2 depicts entry portions 8,9 bearing slidably against the side walls 2 adjacent the open top of the housing whereat the PTC element 3 is to be inserted The retaining elements preferably each have a generally planar portion which is parallel to the electrodes of the PTC component, and which preferably carry one or more convex portions which contact the electrodes. The convex portions are preferably offset from each other. There may be one convex portion 11 on each planar portion, or two or more convex portions on one or both of the planar portions, preferably arranged so that the sum of the forces exerted on the PTC component is at right angles to the plane of the electrodes. The planar portion preferably lies between an elastically deformed base portion which slopes towards the other retaining element, and an entry portion which slopes away from the other retaining element. The entry portions serve to guide a PTC element into place as it is inserted between the retaining elements, and the ends thereof may bear against the side walls of the housing to modify the elastic deformation of the retaining elements. The retaining elements are preferably mirror images of each other except for the convex portions.

The terminal elements are preferably male terminals 13. Especially when they are, the housing preferably includes an insulating separating member 12 which extends from a housing base between the terminal elements, and which ensures that there can be no electrical contact between terminated wires which are secured to the terminal elements. The housing may also comprise means for securing the device to a structure, e.g. a loudspeaker box.

The PTC conductive polymers used in the present invention preferably comprise a crystalline polymer component and, dispersed in the polymer component, a particulate filler component which comprises a conductive filler, e.g. carbon black or a metal. The filler component may also contain a non-conductive filler, which changes not only the electrical properties of the conductive polymer but also its physical properties. The composition can also contain one or more other components, e.g. an antioxidant, crosslinking agent, coupling agent or elastomer. For use in circuit protection devices, the PTC composition preferably has a resistivity at 23° C. of less than 50 ohm-cm, particularly less than 10 ohm-cm, especially less than 5 ohm-cm. Suitable conductive polymers for use in this invention are disclosed for example in U.S. Pat. Nos. 4,237,441 (van Konynenburg et al), 4,304,987 (van Konynenburg), 4,388,607 (Toy et al), 4,514,620 (Cheng et al), 4,534,889 (van Konynenburg et al), 4,545,926 (Fouts et al), 4,560,498 (Horsma et al), 4,591,700 (Sopory), 4,724,417 (Au et al), 4,774,024 (Deep et al), 4,935,156 (van Konynenburg), and 5,049,850 (Evans et al), and copending, commonly assigned U.S. Pat. Application No. 07/893,626 (Chandler et al, filed Jun. 5, 1992). The disclosure of each of these patents and applications is incorporated herein by reference.

When a PTC device is tripped, most of the voltage dropped over the device is normally dropped over a relatively small part of the device which is referred to as the hot line, hot plane or hot zone. In the devices of the invention, the PTC element can have one or more features which help the hot line to form at a desired location, usually spaced apart from both electrodes. Suitable features of this kind for use in the present invention are disclosed for example in U.S. Pat. Nos. 4,317,027 and 4,352,083 (Middleman et al), 4,907,340 and 4,924,072 (Fang et al), the disclosures of which are incorporated herein by reference.

Particularly useful PTC elements for use in this invention comprise two metal foil electrodes, 14,15, and a PTC conductive polymer 16 sandwiched between them, especially such elements which have low resistance at 23° C., generally less than 50 ohm, preferably less than 15 ohm, more preferably less than 10 ohm, particularly less than 5 ohm, especially less than 3 ohm. Particularly suitable foil electrodes are microrough metal foil electrodes, including in particular electrodeposited nickel foils and nickel-plated electrodeposited copper foil electrodes, in particular as disclosed in U.S. Pat. Nos. 4,689,475 (Matthiesen) and 4,800,253 (Kleiner et al), the disclosure of each of which is incorporated herein by reference. A variety of laminar devices which can be used in the present invention are disclosed in U.S. Pat. Nos. 4,238,812 (Middleman et al), 4,255,698 (Simon), 4,272,471 (Walker), 4,315,237 (Middleman et al), 4,317,027 (Middleman et al), 4,330,703 (Horsma et al), 4,426,633 (Taylor), 4,475,138 (Middleman et al), 4,724,417 (Au et al), 4,780,598 (Fahey et al), 4,845,838 (Jacobs et al), 4,907,340 (Fang et al), and 4,924,074 (Fang et al), the disclosure of each of which is incorporated herein by reference. The electrodes can be modified so as to produce desired thermal effects.

What is claimed is:

1. A PTC device which comprises (1) a housing which is composed of an electrically insulating material and which is an open box comprising
  (i) a base having first and second spaced-apart apertures therethrough
  (ii) first and second side walls extending from the bases and
  (iii) an open top;

(2) a first metal member which
  (a) passes through the first aperture, and
  (b) comprises
    (i) a first terminal element which lies outside the housing, and
    (ii) a first retaining element which lies wholly within the housing and which comprises
      a first elastically deformed base portion which is secured to the base of the housing,
      a first elastically deformed entry portion which bears slidably against the first side wall of the housing adjacent the open top of the housing, and
      a first generally planar portion which lies between the first base portion and the first entry portion and is spaced apart from the housing;

(3) a second metal member which
  (a) passes through the second aperture and
  (b) comprises
    (i) a second terminal element which lies outside the housing, and
    (ii) a second retaining element which lies wholly within the housing and which comprises
      a second elastically deformed base portion which is secured to the base of the housing
      a second elastically deformed entry portion which bears slidably against the second side wall of the housing adjacent the open top of the housing and a second generally planar portion which lies between the second base portion and the second entry portion and is spaced apart from the housing:

the first and second base portions sloping towards each other as they approach the first and second planar portions respectively, and the first and second planar portions sloping away from each other as they recede from the first and second planar portions respectively; and (4) a PTC component which (a) comprises (i) a first laminar metal electrode which is adjacent and parallel to the first generally planar portion, (ii) a second laminar metal electrode which is parallel to the first electrode and which is adjacent and parallel to the second generally planar portion, and (iii) a laminar resistive element which is composed of a PTC conductive polymer and which is sandwiched between the first and second electrodes, (b) is positioned between the first and second retaining elements, with the first electrode being in physical and electrical contact with the first generally planar portion and the second electrode being in physical and electrical contact with the second generally planar portion and (c) is removably maintained in position between the first and second retaining elements by elastic recovery forces exerted on the first and second electrodes by the first and second retaining elements.

2. A device according to claim 1 wherein the first generally planar portion comprises at least on first convex portion which contacts the first electrode, and the second generally planar portion comprises at least one second convex portion which contacts the second electrode.

3. A device according to claim 2 said generally planar portion comprises wherein at least two of said first convex portions.

4. A device according to claim 1 wherein the housing includes an insulating separating member which extends from the base between the first and second terminals elements.

5. A device according to claim 4 wherein each of the first and second terminal elements is a male connector.

* * * * *